US008281949B2

(12) United States Patent
Scholen et al.

(10) Patent No.: US 8,281,949 B2
(45) Date of Patent: Oct. 9, 2012

(54) PRODUCT DISPLAY CONTAINER HAVING HINGED SIDE PANELS WITH A SLIDABLE GATE MEMBER TO SELECTIVELY BLOCK ACCESS THROUGH A PORT IN AT LEAST ONE SIDE PANEL

(75) Inventors: Jonah Scholen, Minneapolis, MN (US); David Burghart, Bentonville, AR (US)

(73) Assignee: Target Brands, Inc., Minneapolis, MN (US)

( * ) Notice: Subject to any disclaimer, the term of this patent is extended or adjusted under 35 U.S.C. 154(b) by 1538 days.

(21) Appl. No.: 11/324,535

(22) Filed: Jan. 3, 2006

(65) Prior Publication Data

US 2007/0012640 A1 Jan. 18, 2007

Related U.S. Application Data

(60) Provisional application No. 60/641,687, filed on Jan. 4, 2005.

(51) Int. Cl.
*B65D 6/08* (2006.01)
*B65D 6/18* (2006.01)

(52) U.S. Cl. ..... 220/485; 220/495

(58) Field of Classification Search ..... 211/181.1, 211/199, 204, 206; 220/485, 489, 495
See application file for complete search history.

(56) References Cited

U.S. PATENT DOCUMENTS 952,603 A * 3/1910 Carroll ..... 211/199
2,100,548 A * 11/1937 Maxin ..... 108/59
2,314,490 A * 3/1943 Goldman ..... 248/149
D162,397 S 3/1951 Fink
D166,307 S 4/1952 Gibbs
2,680,522 A * 6/1954 Temple ..... 211/181.1
2,756,901 A 7/1956 Cowsert
2,940,642 A 6/1960 Strattman
3,093,261 A * 6/1963 Salat ..... 220/485
3,139,185 A 6/1964 Wentz
3,288,484 A * 11/1966 Brunette ..... 280/79.2
3,371,795 A 3/1968 Rosonke
3,371,950 A 3/1968 Stap
3,967,734 A * 7/1976 Morgan et al. ..... 211/199
4,180,277 A * 12/1979 Romero ..... 280/79.3
4,222,579 A * 9/1980 Frydendal ..... 280/33.996
D282,797 S 3/1986 Dixon
4,819,899 A 4/1989 Weil
4,953,879 A 9/1990 Cain et al.
4,978,013 A * 12/1990 Hogg ..... 211/133.2
5,101,995 A * 4/1992 Trubiano ..... 220/7
D331,680 S 12/1992 Glassenberg
D365,716 S 1/1996 Rose, Sr.
D369,483 S 5/1996 Kandel
5,765,702 A * 6/1998 Bustos et al. ..... 211/181.1

(Continued)

*Primary Examiner* — Michael Safavi

(74) *Attorney, Agent, or Firm* — Nixon & Vanderhye P.C.

(57) ABSTRACT

Systems and methods include unfolding a product bin from a flat configuration to vertical configuration to define a portion of a product enclosure. The product bin comprises a plurality of sections hinged end-to-end in a chain. A free end of a first one of the sections in the chain is releasably connected to a free end of a last one of the sections in the chain with a support member. The support member is fastened to an object such that the plurality of sections and the object combine to define a product enclosure. A plurality of products is placed in the product enclosure.

12 Claims, 8 Drawing Sheets

U.S. PATENT DOCUMENTS 6,062,402 A * 5/2000 Ford ..... 211/189
6,406,107 B1 6/2002 Franczak
6,659,294 B1 * 12/2003 Simard ..... 211/181.1
2003/0173322 A1 * 9/2003 Rushing ..... 211/181.1

* cited by examiner

PRODUCT DISPLAY CONTAINER HAVING HINGED SIDE PANELS WITH A SLIDABLE GATE MEMBER TO SELECTIVELY BLOCK ACCESS THROUGH A PORT IN AT LEAST ONE SIDE PANEL

CROSS-REFERENCE TO RELATED APPLICATIONS

This patent application claims priority under 35 U.S.C. §119(e) to U.S. Provisional Patent Application Ser. No. 60/641,687, entitled "PRODUCT DISPLAY CONTAINER," having a filing date of Jan. 4, 2005, the contents of which are incorporated herein by reference.

BACKGROUND OF THE INVENTION

Merchandise and various retail items are often displayed and/or housed in a retail environment using shelving, containers, stands, or other structures. For example, toys, such as balls, are often displayed in bins at an end, or endcap, of shelving.

SUMMARY OF THE INVENTION

One aspect of the present invention relates to a method of assembling a product bin including unfolding the product bin from a flat configuration to a substantially vertical configuration to define a portion of a product enclosure. The product bin comprises a plurality of sections hinged end-to-end in a chain. A free end of a first one of the sections in the chain is releasably connected to a free end of a last one of the sections in the chain with a support member. The support member is fastened to an object such that the plurality of sections and the object combine to define a product enclosure. A plurality of products is placed in the product enclosure.

While one aspect of the present invention has been described above, other related products, methods, and systems are also disclosed and provide additional advantages.

BRIEF DESCRIPTION OF THE DRAWINGS

Embodiments of the invention are described with respect to the figures, in which like reference numbers denote like elements, and in which.

DETAILED DESCRIPTION

Figure 1:
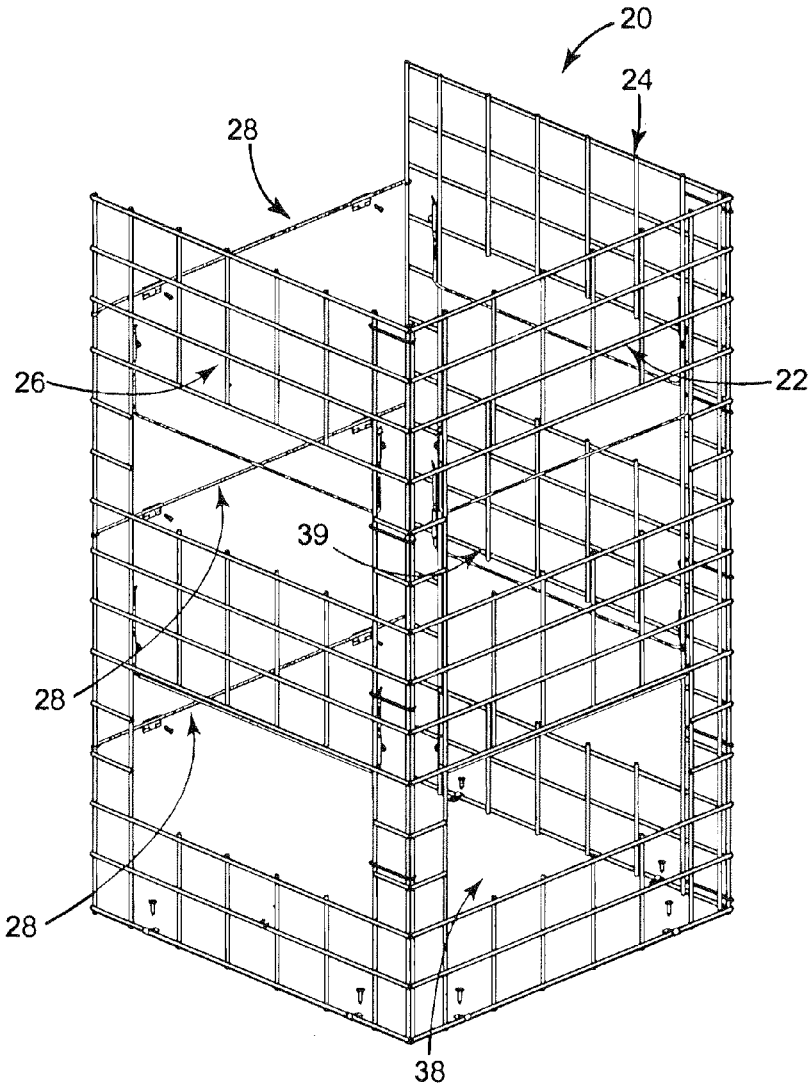
FIG. 1 shows a perspective view of a product display container, according to an embodiment of the present invention.

With reference to FIG. 1, a product display container 20, otherwise described as a product dispensing enclosure, a product bin, a bin, or a selectively accessible container, includes a first section 22, a second section 24, a third section 26, and a plurality of support members 28*a*, 28*b* and 28*c* (hereinafter '28'), or a plurality of connectors. The plurality of sections 22, 24, 26 are also optionally described as side panels or walls.

Figure 2A:
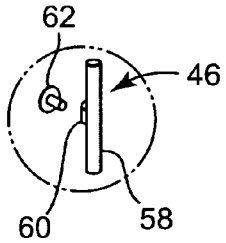
FIG. 2A shows a perspective view of a restriction member guide of the product display container of FIG. 1, according to an embodiment of the present invention.
Figure 2:
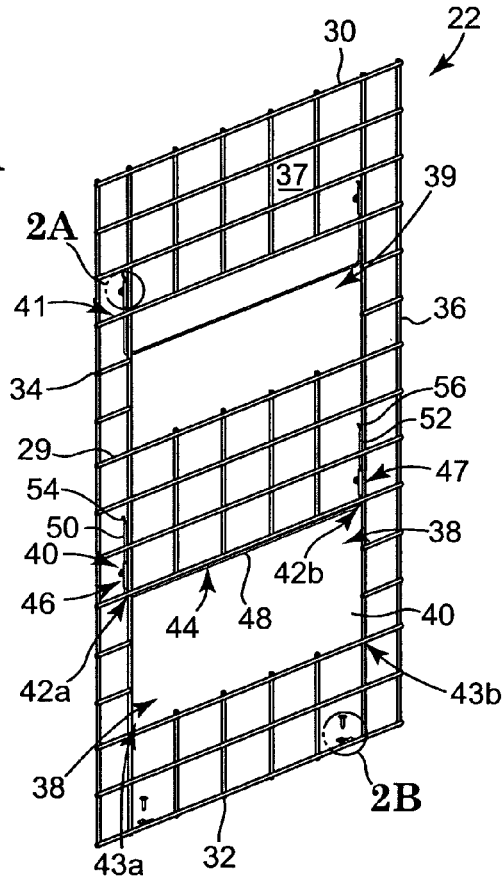
FIG. 2 shows a perspective view of a first section of the product display container of FIG. 1, according to an embodiment of the present invention.

With reference to FIG. 2, the first section 22 includes a body 29 defining a top 30, a bottom 32, a back side (not shown), a first side 34, a second side 36, a front side 37, and a first access opening 38, also described as a port. The body 29 optionally defines a second access opening 39, or port, or a plurality of access openings, or ports, as desired. The first section 22 also optionally includes a first adjustment assembly 40, also described as a first gate assembly, for selectively blocking a portion of the first access opening 38, and a second adjustment assembly 41, also described as a second gate assembly, for selectively blocking a portion of the second access opening 39.

The body 29 is optionally formed of wireframe material, including 3/0 gauge wire, for example. However, it should be noted the body 29 is also optionally formed of materials such as plastic, for example. In one embodiment, the body 29 defines a top-to-bottom height of about 78.5 inches with a width of about 45.4 inches.

The first access opening 38 is optionally substantially rectangular, defining a first upper corner 42*a*, a second upper corner 42*b*, a first lower corner 43*a*, and a second lower corner 43*b*. The second access opening 39 is optionally substantially similar to the first access opening 38. However, various shapes and sizes, including different shapes and sizes for each of the first and second access openings 38, 39, are contemplated.

The first access opening 38 is about 34.6 inches wide and about 16.5 inches tall, for example. The first access opening 38 is optionally substantially centered between the first side 34 and the second side 36 of the body 29, and positioned a minimum distance of about 11.5 inches from the bottom 32 of the body 29, for example. The second access opening 39 is about 34.6 inches wide, about 16.5 inches tall, substantially centered between the first side 34 and the second side 36 of the body 29, and positioned a minimum distance of about 17 inches above the first access opening 38, for example. However, it should be noted that a variety of sizes and positions are also acceptable.

The first adjustment assembly 40 includes a restriction member 44 (shown in greater detail in FIG. 3), also described as a gate member, a first restriction member guide 46 (shown in greater detail in FIG. 2A), also described as a first guide sleeve, and a second restriction member guide 47, also described as a second guide sleeve. In general terms, the first adjustment assembly 40 is configured to selectively block, or adjust access to, the first access opening 38.

Figure 3:
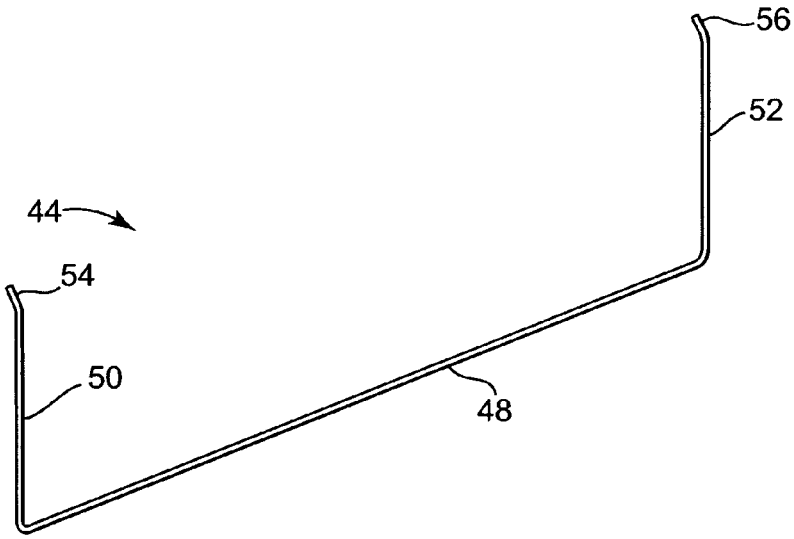
FIG. 3 shows a perspective view of a restriction member of the product display container of FIG. 1, according to an embodiment of the present invention.

With reference to FIG. 3, the restriction member 44 defines a central portion 48, also termed a body, a first leg 50, also termed a first portion, and a second leg 52, also termed a second portion. The first leg 50 and the second leg 52 optionally extend in an opposing fashion from the central portion 48. Additionally, the restriction member 44 is optionally formed of 1/0 gauge wire. However, other materials are also contemplated.

Each of the first leg 50 and the second leg 52 includes stops 54, 56, respectively. For example, the stops 54, 56 are optionally formed as bent portions in each of the legs 50, 52. As will become more apparent below, the stops 54, 56 help retain the restriction member 44 in the restriction member guides 46, 47.

The central portion 48 is optionally as long as, or longer than, the first access opening 38 is wide, but need not be. It should also be understood that the central portion 48 optionally includes a bend, or bends, along the length of the central portion 48, is optionally formed of multiple wires, and/or optionally includes accessories such as flaps, tags, or other devices as desired.

The stops 54, 56, are optionally formed as bent portions and are each about 1 inch in length, for example. Each of the legs 50, 52 is about 10 inches in overall length including the stops 54, 56, for example. Additionally, the central portion 48 is about 35 inches in length, for example. It should be apparent that other dimensions are also contemplated.

With reference to FIG. 2A, the first restriction member guide 46 includes a hollow, tubular leg receptacle 58, or a tubular body, a weld nut 60 fixed to the leg receptacle 58, and a set screw 62, for example a thumb screw, receivable within the weld nut 60. Each of the leg receptacle 58, the weld nut 60, and the set screw 62 is formed of metal, plastic, or other suitable materials.

The leg receptacle 58 has an inner lumen (not shown) and is adapted to slidably and coaxially receive the first leg 50 of the restriction member 44 within the inner lumen. In particular, the leg receptacle 58 is optionally adapted to serve as a fixture for the restriction member 44 in combination with the weld nut 60 and set screw 62, as is described in greater detail below.

The weld nut 60 is female threaded, for example, and adapted to receive the set screw 62. In particular, the weld nut 60 is optionally welded to the leg receptacle 58 with a female threaded portion open to the inner lumen of the leg receptacle 58 such that the set screw 62 is screwable into the weld nut 50 and partially into the inner lumen of the leg receptacle 58.

In particular, the set screw 62 is optionally coaxially received in the weld nut 50 and is male-threaded, for example. The set screw 62 is adapted to be actuated, or screwed, into the weld nut 50 to set, or select, a position of the first leg 50 in the leg receptacle 58 as desired.

The first restriction member guide 46, and in particular the leg receptacle 58, is welded to the back side (not shown) of the body 29 in a vertical position and proximate the access opening 38. The first restriction member guide 46 is optionally positioned such that the set screw 62 extends away from the back side (not shown) of the first section 22 when received within the weld nut 60. Additionally, the first restriction member guide 46 is welded to the back side of the first section body 29 proximate the first upper corner 42*a* of the access opening 38, for example. As will be understood in greater detail below, the first restriction member guide 46 provides means for selectively setting a desired position of the restriction member 44 over the first access opening 38.

The second restriction member guide 47 is optionally substantially similar to the first restriction member guide 46, also providing means for selectively setting a desired position of the restriction member 44 over the first access opening 38. For example, the second restriction member guide 47 is optionally welded above the second upper corner 42*b* of the first access opening 38 and is adapted to selectively set a desired position of the second leg 52.

With reference to FIG. 2, the first leg 50 of the restriction member 44 is slidably received within the first restriction member guide 46 while the second leg 52 is slidably received within the second restriction member guide 47. If desired, the stops 54, 56 are optionally formed after the first and second legs 50, 52 have been inserted into the first and second restriction member guides 46, 47, respectively.

Once the first and second legs 50, 52 have been assembled into the first and second guides 46, 47, the central portion 48 is selectively adjusted, or set, at various locations relative to the access opening 38. For example, the central portion 48 is capable of being slid upwardly such that the central portion 48 does not interfere with, or block, the access opening 38. In turn, the central portion 48 is also slidable downwardly, for example until the stops 54, 56 contact the restriction member guides 46, 47 thereby preventing further downward motion. From this, it should also be understood that the central portion 48 is selectively adjustable to any of a number of positions by loosening and then setting, or fixing, one or both of the legs 54, 56 within the first restriction member guide 46 and/or the second restriction member guide 47, respectively. In this manner, the first access opening 38 and the first adjustment assembly 40 in combination provide an adjustable opening, also described as an adjustable product opening or a selectively sizable opening, in the first section 22.

While the restriction member 44 is optionally stopped from traveling an entire height of the access opening 38, it should also be understood that the restriction member 44 is also optionally adapted to be adjustable through the entire height of the access opening 38. Furthermore, the restriction member guides 46, 47 are optionally located proximate lower corners 43*a*, 43*b* of the first access opening 38, with the central portion 48 adjustable upwardly from the lower corners 43*a*, 43*b*, rather than downwardly from the top corners 42*a*, 42*b* of the first access opening 38. If desired, the restriction member guides 46, 47 are optionally welded to the front side 37 of the first section 22. Furthermore, while set-screw type means are described, other means of selectively adjusting a position of the restriction member 44, including, for example, magnets, detents, friction fits, gears, pulleys, and others are also contemplated.

The second adjustment assembly 41 optionally operates in a substantially similar manner to the first adjustment assembly 40, providing means for adjustably, or selectively, blocking a portion of the second access opening 39. In particular, the second adjustment assembly 41 is adjusted to a desired height, or position, relative to the second access opening 39, and set, or secured, at the position, for example via set-screw type means. In this manner, the second access opening 39 and the second adjustment assembly 41 in combination provide an adjustable opening, also termed an adjustable product opening or a selectively sizable opening, of the first section 22.

Figure 4:
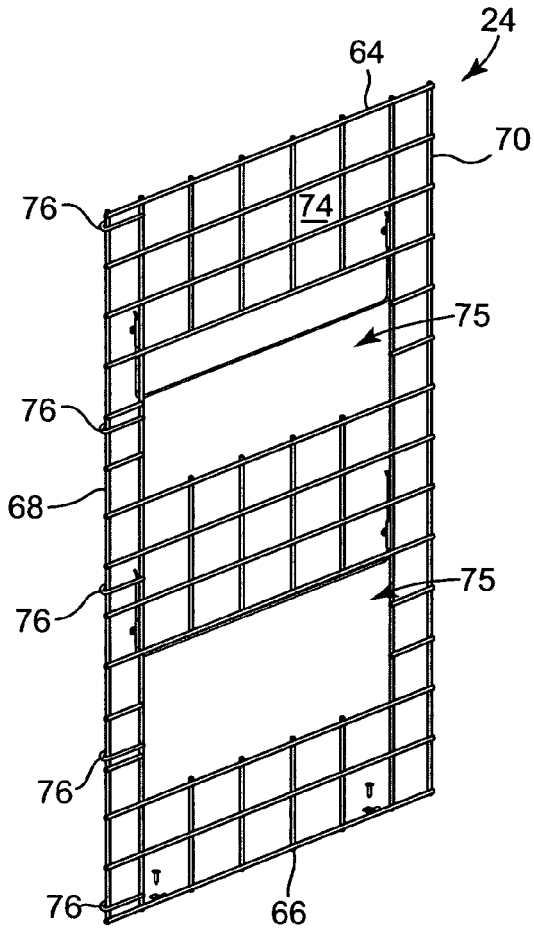
FIG. 4 shows a perspective view of a second section of the product display container of FIG. 1, according to an embodiment of the present invention.

With reference to FIG. 4, the second section 24 is optionally substantially similar to the first section 22. For example, the second section 24 includes wireframe material and defines a top 64, a bottom 66, a first side 68, a second side 70, a back side (not shown) and front side 74. The second section 24 is optionally of substantially similar dimensions to the first section 22, but need not be. The second section 24 is optionally formed from wireframe material, or any of the materials discussed in association with the first section 22. Additionally, and similarly to the first section 22, the second section 24 optionally includes a plurality of adjustable openings 75, otherwise described as adjustable product openings or selectively sizable openings. If desired, the plurality of adjustable openings 75 incorporate substantially similar dimensions and operate substantially similarly to the combination of the first and second access openings 38, 39 and the first and second adjustment assemblies 40, 41 of the first section 22.

Figure 8:
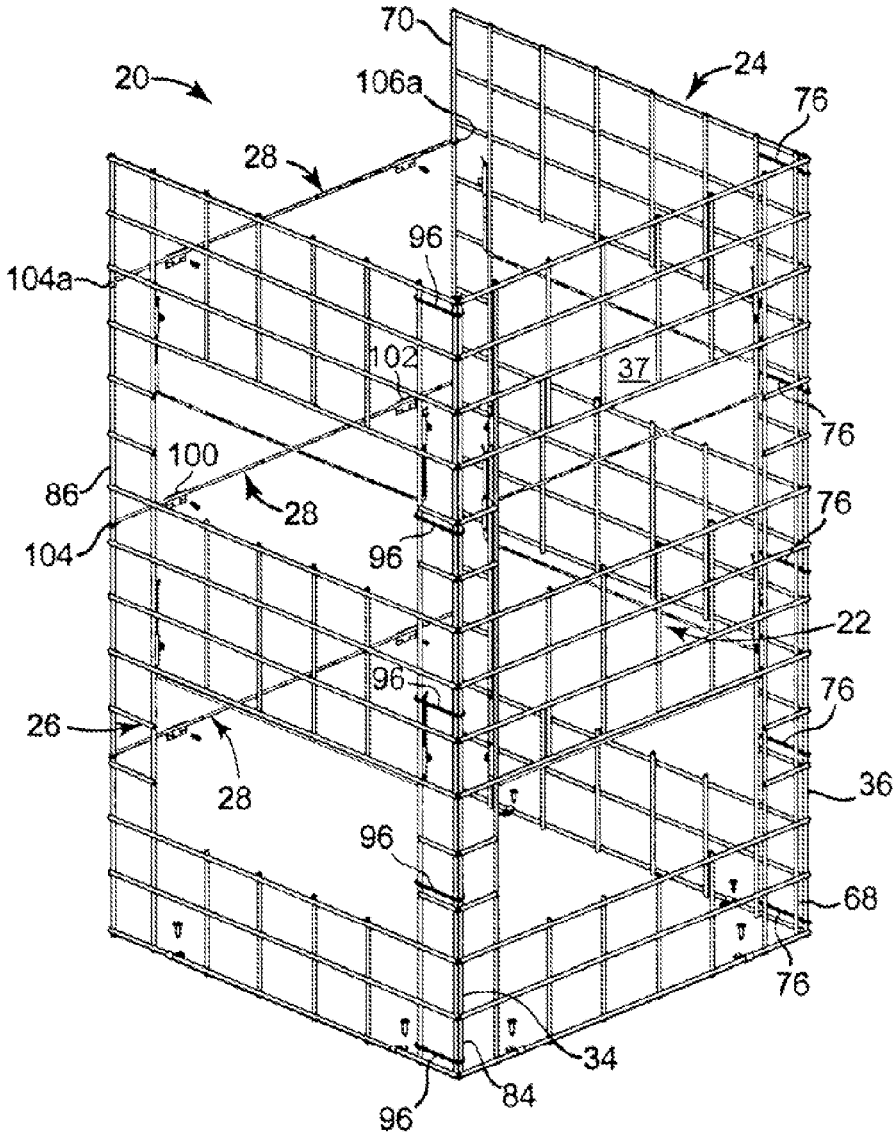
FIG. 8 shows a perspective view of the product display container of FIG. 1, according to an embodiment of the present invention.

The second section 24 is optionally hinged, or rotatably connected, end-to-end, or side-to-side, to the first section 22. For example, the second section 24 optionally includes a plurality of wire hooks 76 serving as hinging means and welded proximate to the first side 68 of the second section 24. With reference to FIG. 8, the plurality of wire hooks 76 are clinched about wireframe material of the first section 22 proximate the second side 36. It should be noted that the second section 34 is also optionally hinged to the first section 22 by welding the plurality of wire hooks 76 proximate to the second side 36 of the first section 22 and clinching the plurality of wire hooks 76 about a portion of the wireframe material of the second section 24 proximate the first side 68. Furthermore, the plurality of wire hooks 76 are also optionally clinched about portions proximate each of the first side 68 of the second section 24 and the second side 36 of the first section 22.

Figure 5:
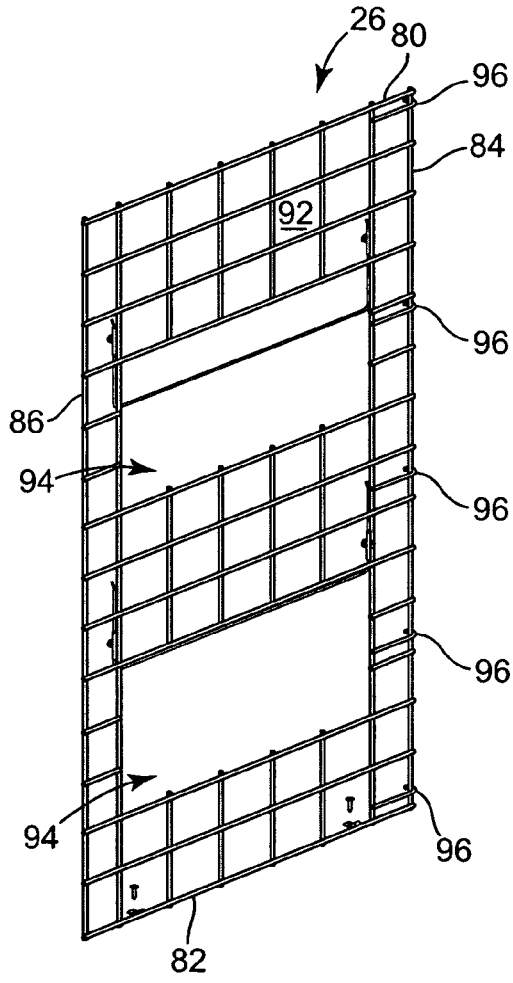
FIG. 5 shows a perspective view of a third section of the product display container of FIG. 1, according to an embodiment of the present invention.

With reference to FIG. 5, the third section 26 is also optionally substantially similar to the first section 22 and/or the second section 24. For example, the third section 26 includes wireframe material and defines a top 80, a bottom 82, a first side 84, a second side 86, a back side (not shown), and a front side 92. The third section 26 is optionally of substantially similar dimensions to the first section 22 and/or second section 24. While, the third section 26 is optionally formed from wireframe material, the third section 26 is also optionally formed of any of the materials discussed in association with the first and/or second sections 22, 24. Additionally, the third section 26 optionally includes a plurality of adjustable openings 94, otherwise described as selectively sizable openings. If desired, the plurality of adjustable openings 94 incorporate substantially similar dimensions and operate substantially similarly to the combination of the first and second access openings 38, 39 and the first and second adjustment assemblies 40, 41.

The third section 26 is also hinged, or rotatably connected, end-to-end, also described as side-to-side, to the first side 34 of the first section 22. For example, the third section 26 optionally includes a plurality of wire hooks 96 serving as hinging means and welded proximate the first side 84 of the third section 26. With reference to FIG. 8, the plurality of wire hooks 96 are clinched about wireframe material of the first section 22 proximate the first side 34. It should be noted that the plurality of wire hooks 96 are optionally welded to the first section 22 and clinched about wireframe material of the third section 26. Furthermore, the plurality of wire hooks 96 are also clinched about wireframe materials of each of the first section 22 and the third section 26, if desired.

Figure 6:
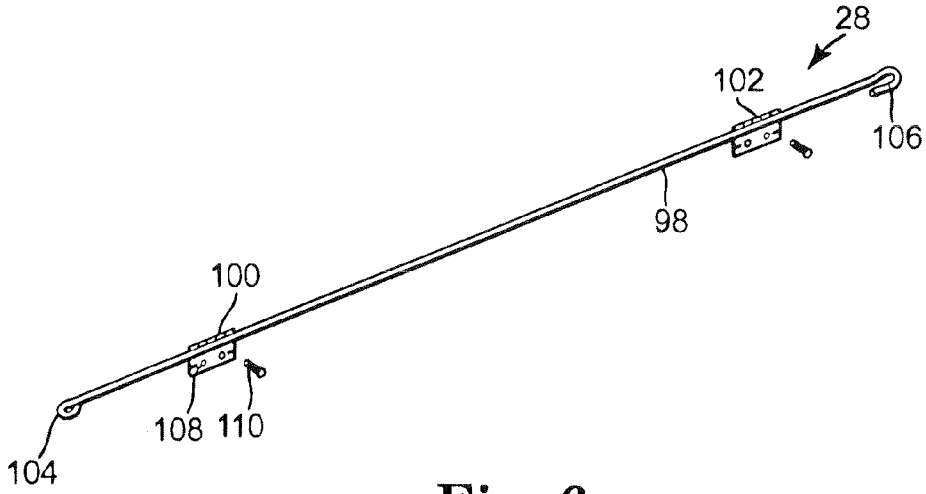
FIG. 6 shows a perspective view of a support member of the product display container of FIG. 1, according to an embodiment of the present invention.

With reference to FIG. 6, the plurality of support members 28 are optionally substantially similar to one another. Each support member 28 includes a support member body 98, a first bracket 100, and a second bracket 102. The support member body 98 is optionally formed of 3 gauge wire, for example, and extends a length to define a first end 104 and a second end 106. The length is optionally substantially similar to the width of the first section 22, and in one embodiment is about 44.9 inches, for example. It should also be understood that other materials and/or dimensions are also contemplated.

Figure 7:
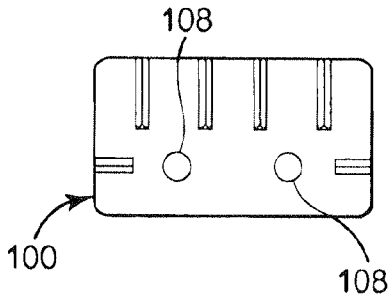
FIG. 7 shows a front view of a bracket of the product display container of FIG. 1, according to an embodiment of the present invention.

The first bracket 100 and the second bracket 102 are optionally substantially similar in construction, and as such, some features of both the first bracket 100 and the second bracket 102 are described cumulatively with reference to the first bracket 100. For example, and with reference to FIG. 7, the first bracket 100 is substantially rectangular and includes two holes 108 each configured to accept a fastener 110, for example, a plastic clip, such as a "Christmas tree" clip. The first bracket 100 is optionally about 2.5 inches wide and about 1.375 inches in height, although other dimensions are contemplated.

With additional reference to FIG. 6, the first and second brackets 100,102 are affixed proximate the opposing ends 104,106 of the support member body 98, respectively. Additionally, the brackets 100, 102 are optionally formed of metal and/or welded to the support member body 98.

With reference to FIGS. 6 and 8, the first end 104 of the support member body 98 is clinched, or bent over, onto a portion of the third section 26 proximate second side 86 such that the first end 104 is rotatably connected to the second side 86. However, the first end 104 is also optionally clinched, or bent over, onto a portion of the wireframe material of the second section 24 proximate the second side 86. The second end 106 of the support member body 98 is secured to the wireframe material of the second section 24 proximate the second side 70. For example, the second end 106 is optionally formed to define a hook, for example a shepherd hook, such that the second end 106 is releasably affixed to the wireframe material of the second section 24 proximate the second side 70. The plurality of support members 28 are optionally secured in a substantially similar manner between the second and third sections 24, 26. Additionally, the plurality of support members 28 provide a means for affixing, or otherwise attaching the product display container 20 to an object or structure 112 (FIG. 9) within a desired environment, such as a retail store.

It light of the above, it should be understood that the sections 22, 24, 26 provide folding means such that the product display container 20 is adapted to fold to define a flattened state, and expand outwardly to define a substantially rectangular transverse perimeter with the plurality of support members 28 connecting the second and third sections 24, 26. It should be noted that variations in the design of the support member 28 or other connectors between the second and third sections 24, 26 are contemplated. For example, the plurality of support members 28 are optionally substantially similar to the first section 22, the second section 24, and/or the third section 26. As another example, the support member 28 is optionally formed as a substantially solid structure if desired.

With reference to FIG. 8, the product display container 20 is shown expanded, or unfolded, to a vertical and assembled state. As shown, the first section 22, second section 24, and third section 26 are connected together end-to-end in a chain to optionally form three walls, or side panels, of a substantially rectangular transverse perimeter of the product display container 20. With the configuration shown, each of the plurality of sections 22, 24, 26 is hinged end-to-end to an adjacent section and is capable of being folded into a substantially flat configuration (not shown) and unfolded or expanded to an active, or substantially upright, configuration, or position, as referenced above.

In particular, each of the first and last sections in the chain defines a free end. For example, the second section 24 defines a hinged end at the first side 68 and an unhinged end, or free end, at the second side 70. The third section 26 also defines a hinged end at the first side 84 and an unhinged end, or free end, at the second side 86. With each of the plurality of support members 28 hinged, or rotatably connected to the unhinged end of the third section 26 and disconnected from the second section 24, the various sections 22, 24, 26 are free to fold onto one another. In turn, the sections 22, 24, 26 are optionally secured in an expanded state with the plurality of support members 28 connecting the first and last sections in the chain, for example the second and third sections 24, 26. While the product display container 20 is secured in a substantially rectangular configuration with the plurality of support members 28, it should be understood that other shapes are also contemplated.

Figure 9:
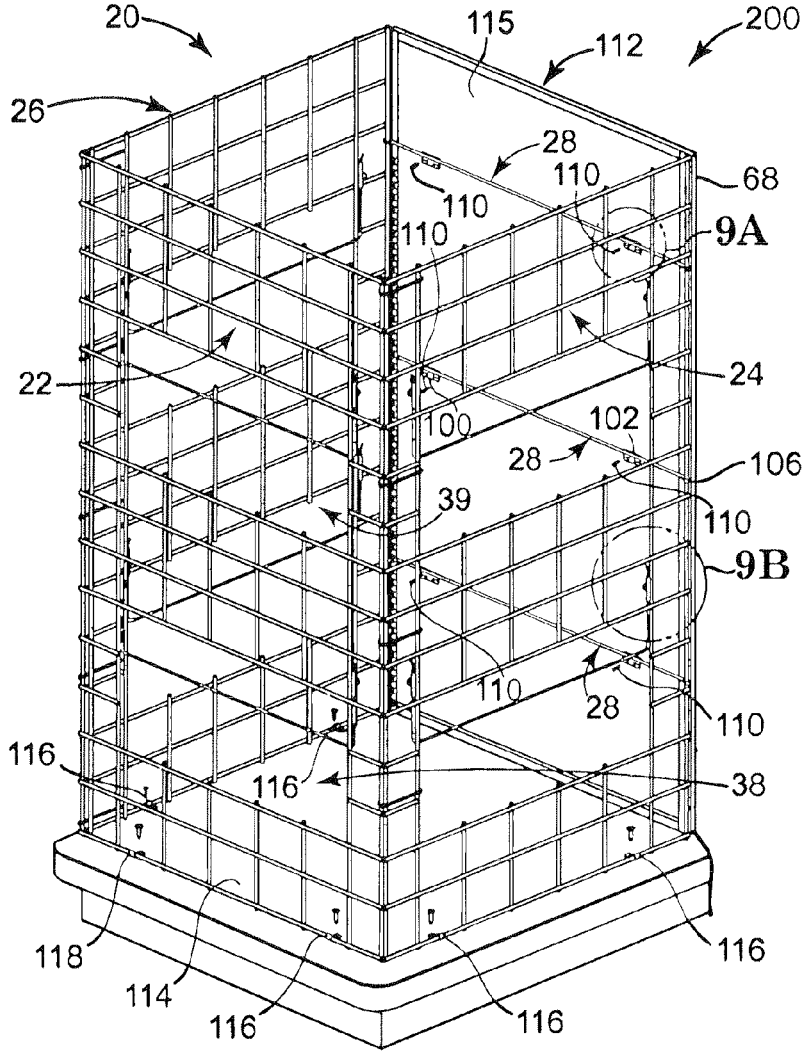
FIG. 9 shows a perspective view of the product display container of FIG. 1 assembled to an endcap, according to an embodiment of the present invention.
Figure 9A:
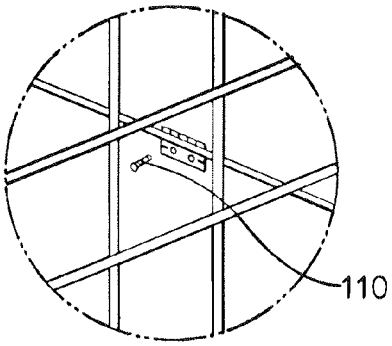
FIG. 9A shows a perspective view of a portion of the product display container of FIG. 10, according to an embodiment of the present invention.
Figure 9B:
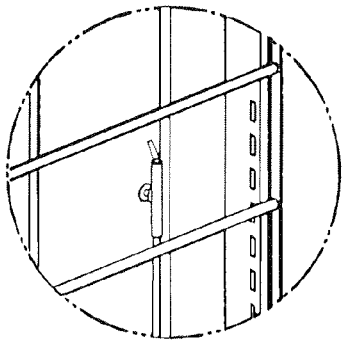
FIG. 9B shows a perspective view of a portion of the product display container of FIG. 10, according to an embodiment of the present invention.

With reference to FIGS. 9, 9A, and 9B, a method of assembling a product display system 200 is described in greater detail. The product display system 200 includes the product display container 20 and the structure 112. The method of assembling the system 200 optionally includes transitioning, or unfolding, the product display container 20 from the flat configuration (not shown) to the active or substantially vertical configuration. As previously described, the active configuration includes the product display container 20 being substantially upright and forming a generally rectangular transverse perimeter, or product enclosure, with the plurality of support members 28 releasably connecting the second section 24 and the third section 26.

The brackets 100,102 of the support member 28 are optionally used as a support anchor to attach, or anchor, the three sections 22, 24, 26 to the structure 112. The structure 112 is optionally a shelf endcap including a basedeck 114 and a backing portion 115, for example. The backing portion 115 is optionally formed of pegboard material. The support member 28 is optionally attached to the backing portion 115 utilizing the plurality of clips 110, for example "Christmas tree" clips, secured in the bracket holes 108 (FIG. 7) and holes (not shown) associated with the backing portion 115, for example pegboard holes of the backing portion 115.

Figure 2B:
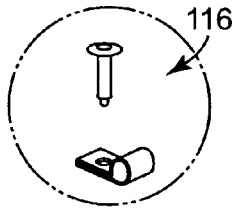
FIG. 2B shows a cable hold down fastener of the product display container of FIG. 1, according to an embodiment of the present invention.

The three sections 22, 24, 26 are also anchored to the basedeck 114 with a plurality of fasteners 116 (FIG. 2B), for example cable hold down fasteners. However, a variety of fastening means between the backing portion 115, the basedeck 114, and/or the product display container 20 are contemplated. It should also be understood that the structure 112 is optionally a variety of structures or objects, for example, shelves, walls, columns, or other structures found in a retail or store environment.

Once one or more of the plurality of support members 28 have been connected to the structure 112, the outer transverse perimeter of the product display container 20 is defined with a fourth side, or wall, being provided by the structure 112. A product or products (not shown) are optionally placed in the perimeter, or product enclosure, formed by the three sections 22, 24, 26 and the structure 112. The method optionally includes adjusting the first adjustment assembly 40 and/or the second adjustment assembly 41 such that the adjustable opening or openings are sized as desired.

For example, and as previously referenced, adjustment of the first restriction member 44 serves to size, or define, a desired opening through which products (not shown), such as rubber balls, are removed from an interior of the product display container 20. In particular, one or more of the adjustable openings of the first, second, and/or third sections 22, 24, 26 is optionally adjusted to an opening size based on a size of the product or products.

The method also optionally includes adjusting one or more of the adjustable openings to a slightly smaller size than the size of the product or products. For example, where the product is a plurality of large balls, one or more adjustable openings are adjusted to be about 1 inch less in height than a diameter of each of the plurality of balls. The method also includes adjusting one or more of the adjustable openings to be substantially the same height as the product or products. Still yet, one or more of the adjustable openings are optionally adjusted to be of a greater height than the product or products.

In view of the previous sections, it should be understood that such adjustability allows users the option of optimizing removal of the product or products, while at the same time ensuring that the product or products are retained within the interior or product enclosure as defined by the product display container 20 and the structure 112.

Other embodiments of the present invention should now be apparent to those having ordinary skill in the art. For example, the third section 26 is optionally omitted, such that the outer transverse perimeter of the product display container 20 forms a triangle with the structure 112 serving as a "third" wall; still yet, the product displayer container 20 optionally includes a fourth section (not shown) such that the outer transverse perimeter of the product display container 20 forms a pentagon with the structure 112 serving as a "fifth" wall; and so forth.

The present invention achieves several advantages, including: being adaptable to be secured to, and supported on, an endcap of a shelving unit in a retail environment; being foldable to define a smaller size for storage, transportation, and/or set-up; being formed of relatively light wireframe materials for easier transport and set up; having minimized materials by using a portion of another structure as part of the perimeter of the product display container 20; allowing manual assembly without excessive tool use; having adjustable openings to facilitate product accessibility; and/or having an open, wireframe structure facilitating visibility of products housed in the container 20; and others.

In the preceding detailed description, reference is made to the accompanying figures, which form a part hereof, and in which is shown by way of illustration specific embodiments in which the invention may be practiced. In this regard, directional terminology, such as "top," "bottom," "front," "back," "left," "right," etc., is used with reference to the orientation of the Figure(s) being described. Because components of the embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The foregoing detailed description, therefore, is not to be taken in a limiting sense, and the scope of the present invention is defined by the appended claims.

What is claimed is:

1. A product display system comprising:

an endcap of a shelving unit; and a product dispensing enclosure comprising:

a plurality of side panels, each of the plurality of side panels defining a first side and a second side, each of the plurality of side panels hinged side-to-side with an adjacent side panel, two of the plurality of side panels each defining an unhinged, free side; and a support member releasably connecting the unhinged, free sides of each of the two side panels, the support member releasably secured to the endcap;

wherein the endcap and the plurality of side panels combine to define an enclosed perimeter for enclosing a plurality of products, and wherein at least one of the plurality of side panels includes an outer perimeter, an access opening disposed within and spaced from the outer perimeter and opening into the enclosed perimeter, and an adjustment assembly, the adjustment assembly including a restriction member that is selectively positionable along a plane parallel to a plane of the at least one of the plurality of side panels to block a portion of the access opening to provide selective access to the plurality of products, wherein the restriction member comprises:

a body sized to block a portion of the access opening, the body extending from a first end to a second end, a first leg extending angularly from the first end of the body and slidable in a sliding direction, and a second leg extending angularly from the second end of the body and slidable in a sliding direction, and wherein the adjustment assembly comprises:

a first restriction member guide secured proximate the access opening, the first restriction member guide forming a first lumen, the first lumen coaxially and slidably receiving the first leg, wherein the first lumen is oriented in alignment with the sliding direction of the first leg; and a second restriction member guide secured proximate the access opening, the second restriction member guide forming a second lumen, the second lumen coaxially and slidably receiving the second leg, wherein the second lumen is oriented in alignment with the sliding direction of the second leg.

2. The system of claim 1, wherein the restriction member is formed of wire material.

3. The system of claim 1, wherein the at least one of the plurality of side panels forms a first access opening into the enclosed perimeter and a second access opening into the enclosed perimeter, the second access opening located above the first access opening, and further wherein the adjustment assembly of the at least one of the plurality of side panels comprises:

a first adjustment assembly adapted to block a portion of the first access opening to provide selective access to the plurality of products; and a second adjustment assembly adapted to block a portion of the second access opening to provide selective access to the plurality of products.

4. The system of claim 1, wherein each of the plurality of side panels includes wireframe material.

5. The system of claim 1, wherein the support member is one of a plurality of support members each releasably connecting the unhinged, free sides of the two side panels and releasably anchoring the plurality of side panels to the endcap.

6. The system of claim 1, wherein the plurality of sidewalls are each positioned substantially vertically on a surface and the endcap includes a vertical backing portion, the support member releasably secured to the vertical backing portion of the endcap.

7. A product display system comprising:

an endcap of a shelving unit; and a product dispensing enclosure comprising:

a plurality of side panels, each of the plurality of side panels defining a first side and a second side, each of the plurality of side panels hinged side-to-side with an adjacent side panel, two of the plurality of side panels each defining an unhinged, free side; and a support member releasably connecting the unhinged, free sides of each of the two side panels, the support member releasably secured to the endcap;

wherein the endcap and the plurality of side panels combine to define an enclosed perimeter for enclosing a plurality of products, and wherein at least one of the plurality of side panels forms an access opening into the enclosed perimeter and includes an adjustment assembly, the adjustment assembly adapted to block a portion of the access opening as desired to provide selective access to the plurality of products, wherein the adjustment assembly comprises:

a restriction member comprising:

a body sized to block a portion of the access opening, the body extending from a first end to a second end, a first leg extending angularly from the first end of the body, and a second leg extending angularly from the second end of the body;

a first restriction member guide secured proximate the access opening, the first restriction member guide forming a lumen, the lumen coaxially and slidably receiving the first leg; and a second restriction member guide secured proximate the access opening, the second restriction member guide forming a lumen, the lumen coaxially and slidably receiving the second leg, and wherein a position of the first leg in the first restriction member guide is adjustably set with a set screw.

8. A selectively accessible container comprising:

a plurality of walls formed of wire, each of the walls having a first side and a second side, each of the walls hinged at the first sides of each of the walls to an adjacent wall, wherein a first wall and a last wall are each unhinged at one side; and a connector formed of wire, the connector releasably securing each of the unhinged sides of the first wall and the last wall to each other;

wherein at least one of the walls has a fixed port through the wall that is positioned within and spaced from a perimeter of the wall and includes a gate assembly, the gate assembly being adjustable in a plane parallel to a plane of the at least one of the walls and selectively positionable to block a desired portion of the port, wherein the gate assembly comprises:

a gate member formed of wire material, the gate member comprising:

a central portion defining a first end and a second end, the central portion sized to extend across a portion of the port, a first portion extending angularly from the first end of the central portion and slidable in a sliding direction, and a second portion extending angularly from the second end of the central portion and slidable in a sliding direction;

a first guide sleeve including a tubular body forming a lumen coaxially and slidably receiving the first portion of the gate member, wherein the first guide sleeve is oriented in alignment with the sliding direction of the first portion of the gate member; and a second guide sleeve including a tubular body forming a lumen coaxially and slidably receiving the second portion of the gate member, wherein the second guide sleeve is oriented in alignment with the sliding direction of the second portion of the gate member.

9. The selectively accessible container of claim 8, wherein the plurality of walls are foldable into a collapsed configuration upon releasing the unhinged sides of the first and the last walls.

10. The selectively accessible container of claim 8, wherein each of the plurality of walls has a port through each of the walls and each of the plurality of walls includes a gate assembly selectively positionable to block a desired portion of the respective ports of each of the plurality of walls.

11. The selectively accessible container of claim 8, wherein the connector has a first end and a second end, the first end rotatably secured about the second side of the first wall, and the second end of the connector forming a hook releasably secured to the second side of the last wall.

12. A selectively accessible container comprising:

a plurality of walls formed of wire, each of the walls having a first side and a second side, each of the walls hinged at the first sides of each of the walls to an adjacent wall, wherein a first wall and a last wall are each unhinged at one side; and a connector formed of wire, the connector releasably securing each of the unhinged sides of the two walls to one another;

wherein at least one of the walls has a port through the wall and includes a gate assembly, the gate assembly being adjustable and adapted to selectively interfere with the port, and wherein the gate assembly comprises:

a gate member formed of wire material, the gate member comprising:

a central portion defining a first end and a second end, the central portion sized to extend across a portion of the port, a first portion extending angularly from the first end of the central portion, and a second portion extending angularly from the second end of the central portion;

a first guide sleeve including a tubular body forming a lumen coaxially and slidably receiving the first portion of the gate member; and a second guide sleeve including a tubular body forming a lumen coaxially and slidably receiving the second portion of the gate member, wherein the first guide sleeve includes a screw for releasably setting a position of the first portion of the gate member within the lumen of the first guide sleeve.

* * * * *